US008240837B2

(12) United States Patent
Usuda et al.

(10) Patent No.: US 8,240,837 B2
(45) Date of Patent: Aug. 14, 2012

(54) FLUID EJECTING APPARATUS AND IMAGE FORMATION METHOD

(75) Inventors: Hidenori Usuda, Matsumoto (JP); Toshio Kumagai, Shiojiri (JP); Kazutoshi Fujisawa, Okaya (JP)

(73) Assignee: Seiko Epson Corporation, Tokyo (JP)

( * ) Notice: Subject to any disclaimer, the term of this patent is extended or adjusted under 35 U.S.C. 154(b) by 480 days.

(21) Appl. No.: 12/490,521

(22) Filed: Jun. 24, 2009

(65) Prior Publication Data

US 2009/0322804 A1 Dec. 31, 2009

(30) Foreign Application Priority Data

Jun. 30, 2008 (JP) ..... 2008-171456

(51) Int. Cl.
*B41J 2/01* (2006.01)

(52) U.S. Cl. ..... 347/101; 347/102; 347/98

(58) Field of Classification Search ..... 347/100, 347/101, 102, 98
See application file for complete search history.

(56) References Cited

U.S. PATENT DOCUMENTS 6,557,991 B2 * 5/2003 Koitabashi et al. ..... 347/101
2005/0190248 A1 * 9/2005 Konno et al. ..... 347/102

FOREIGN PATENT DOCUMENTS

JP 2003-191594 7/2003

* cited by examiner

*Primary Examiner* — Lam S Nguyen
(74) *Attorney, Agent, or Firm* — Workman Nydegger

(57) ABSTRACT

A fluid ejecting apparatus includes: a fluid ejecting unit that ejects a colored fluid and a colorless fluid toward a fluid ejection target medium; an irradiating unit that irradiates ultraviolet rays onto a fluid that lies on or over the fluid ejection target medium so as to cure the fluid; and a controlling unit that controls the fluid ejecting operation of the fluid ejecting unit and the ultraviolet ray irradiating operation of the irradiating unit. The controlling unit performs control so that the colorless fluid is ejected on an image that is made of the colored fluid that landed on the fluid ejection target medium. After the start of the agglomeration of the colorless fluid that landed on the image, the controlling unit performs control so that ultraviolet rays are irradiated onto the colorless fluid.

5 Claims, 14 Drawing Sheets

FLUID EJECTING APPARATUS AND IMAGE FORMATION METHOD

CROSS-REFERENCE TO RELATED APPLICATION

The entire disclosure of Japanese Patent Application No. 2008-171456, filed Jun. 30, 2008 is expressly incorporated by reference herein.

BACKGROUND

1. Technical Field

The present invention relates to a fluid ejecting apparatus and an image formation method.

2. Related Art

An ink-jet printer that prints an image by ejecting a fluid (e.g., ink) onto various kinds of fluid ejection target media such as a sheet of paper, cloth, film or the like is known as an example of various kinds of fluid ejecting apparatuses.

Some printer is provided with an ink ejection unit that ejects ink (e.g., color ink) onto an ink ejection target medium and an irradiation unit that irradiates ultraviolet rays onto the ink that lies on the ink ejection target medium so as to cure the ink. Ultraviolet rays are irradiated onto ink that was ejected from the ink ejection unit and then landed on the ink ejection target medium. As a result of the exposure to the ultraviolet rays, the ink cures so as to form a print image. An example of such a fluid ejecting apparatus and an image formation method of related art is described in JP-A-2003-191594.

These days, there is a demand for various types of images. For example, there is a demand for an image that has a glossy finish. In order to meet the demand for a glossy image, an ink ejection unit ejects colorless ink (e.g., clear ink). Specifically, colorless ink is ejected on colored ink. Before the ejection of the colorless ink thereon, the colored ink, which landed on an ink ejection target medium, has cured due to exposure to ultraviolet rays. After the ejection of the colorless ink on the cured color ink, ultraviolet rays are irradiated onto the colorless ink. As a result, the layer of the colorless ink, which is a flat layer, is formed over the colored ink. In this way, an image that has a glossy finish as a whole is printed.

As another example of a demand for various types of images, there is a demand for an image that has a decorative finish. Herein, the term "an image that has a decorative finish" or "a decorative image" means, for example, an image that has a concavo-convex irregular pattern formed over the surface of a base image layer thereof so as to give a three-dimensional appearance thereto. However, it has been difficult for an ink-jet printer of related art to print such a decorative image. For example, it has been difficult for an ink-jet printer of related art to add such a decorative touch when a glossy image explained above is printed because, in such a case, a flat layer is formed with the use of colorless ink.

SUMMARY

An advantage of some aspects of the invention is to make it possible to print a decorative image.

In order to address the above-identified problems without any limitation thereto, a fluid ejecting apparatus according to a main aspect of the invention includes: a fluid ejecting section that ejects a colored fluid and a colorless fluid toward a fluid ejection target medium; an irradiating section that irradiates ultraviolet rays onto a fluid that lies on or over the fluid ejection target medium so as to cure the fluid; and a controlling section that controls the fluid ejecting operation of the fluid ejecting section and the ultraviolet ray irradiating operation of the irradiating section, the controlling section performing control so that the colorless fluid is ejected on an image that is made of the colored fluid that landed on the fluid ejection target medium, and after the start of the agglomeration of the colorless fluid that landed on the image, the controlling section performing control so that ultraviolet rays are irradiated onto the colorless fluid.

Other features and advantages offered by the invention will be fully understood by referring to the following detailed description in conjunction with the accompanying drawings.

Referring to the following detailed description in conjunction with the accompanying drawings, one will fully understand at least the following inventive concept of the invention.

A fluid ejecting apparatus according to a first aspect of the invention includes: a fluid ejecting section that ejects a colored fluid and a colorless fluid toward a fluid ejection target medium; an irradiating section that irradiates ultraviolet rays onto a fluid that lies on or over the fluid ejection target medium so as to cure the fluid; and a controlling section that controls the fluid ejecting operation of the fluid ejecting section and the ultraviolet ray irradiating operation of the irradiating section, the controlling section performing control so that the colorless fluid is ejected on an image that is made of the colored fluid that landed on the fluid ejection target medium, and after the start of the agglomeration of the colorless fluid that landed on the image, the controlling section performing control so that ultraviolet rays are irradiated onto the colorless fluid. With such a configuration of a fluid ejecting apparatus, it is possible to facilitate the formation of a concavo-convex irregular pattern over an image, which occurs as a result of the agglomeration of a colorless fluid when ultraviolet rays are irradiated onto the colorless fluid after the start of the agglomeration thereof. For this reason, this aspect of the invention makes it possible to form a decorative print image (e.g., three-dimensional image).

In the configuration of a fluid ejecting apparatus according to the first aspect of the invention explained above, it is preferable that, under the control of the controlling section, the image should be formed as a result of the ejection of the colorless fluid on the colored fluid that landed on the fluid ejection target medium and then was exposed to ultraviolet rays and the subsequent irradiation of ultraviolet rays onto the colorless fluid before the start of the agglomeration of the colorless fluid; the controlling section should perform control so that the colorless fluid is further ejected on the colorless fluid that has cured due to exposure to the ultraviolet rays; and then, after the start of the agglomeration of the colorless fluid, the controlling section should perform control so that ultraviolet rays are irradiated onto the colorless fluid. With such a preferred configuration of a fluid ejecting apparatus, it is possible to facilitate the formation of a concavo-convex irregular pattern over an image, which occurs as a result of the agglomeration of a colorless fluid that has agglomeration property. For this reason, this aspect of the invention makes it possible to form a decorative print image effectively.

In the preferred configuration of a fluid ejecting apparatus described above, it is further preferable that the controlling section should be capable of performing first operation in which, under the control of the controlling section, the colorless fluid is further ejected on the colorless fluid that has cured due to exposure to the ultraviolet rays, which constitutes the image, and then, after the start of the agglomeration of the colorless fluid, ultraviolet rays are irradiated onto the colorless fluid, and should be capable of performing second operation in which, under the control of the controlling section, the colored fluid is ejected on a part of the colorless fluid that has cured due to exposure to the ultraviolet rays, which constitutes the image, then, ultraviolet rays are irradiated onto the colored fluid, then, the colorless fluid is further ejected on the colored fluid that has been exposed to the ultraviolet rays, and then, ultraviolet rays are irradiated onto the colorless fluid before the start of the agglomeration of the colorless fluid; and either one of the first operation and the second operation is selected to be performed. With such a preferred configuration, it is possible to provide a fluid ejecting apparatus having versatility through the selection of operation that is suited for a desired print image.

In the configuration of a fluid ejecting apparatus according to the first aspect of the invention explained above, it is preferable that, under the control of the controlling section, the image should be formed as a result of the ejection of the colorless fluid on the colored fluid that landed on the fluid ejection target medium and then was exposed to ultraviolet rays and the subsequent irradiation of ultraviolet rays onto the colorless fluid before the start of the agglomeration of the colorless fluid; the controlling section should perform control so that ultraviolet rays are irradiated onto the colored fluid after the ejection of the colored fluid onto a part of the colorless fluid that has cured due to exposure to the ultraviolet rays; the controlling section should perform control so that the colorless fluid is further ejected on the colorless fluid and the colored fluid that have cured due to exposure to the ultraviolet rays; and then, after the start of the agglomeration of the colorless fluid, the controlling section should perform control so that ultraviolet rays are irradiated onto the colorless fluid. With such a preferred configuration of a fluid ejecting apparatus, it is possible to print a decorative image having excellent image quality.

In the configuration of a fluid ejecting apparatus according to the first aspect of the invention explained above, it is preferable that a convex should be formed over the image as a result of the curing of the colorless fluid due to exposure to the ultraviolet rays after the start of the agglomeration thereof; and the controlling section should change the degree of the agglomeration of the colorless fluid either by changing the ejection amount of the colorless fluid or by changing the timing of the irradiation of ultraviolet rays, or by changing both of them, so as to adjust the size of the convex that is formed over the image. With such a preferred configuration of a fluid ejecting apparatus, it is possible to print a decorative image with an additional decoration touch by adjusting the size of the convex.

An image formation method according to a second aspect of the invention includes: ejecting a colorless fluid on an image that is made of a colored fluid that landed on a fluid ejection target medium; and curing the colorless fluid by irradiating ultraviolet rays onto the colorless fluid after the start of the agglomeration of the colorless fluid that landed on the image. With such an image formation method, it is possible to facilitate the formation of a concavo-convex irregular pattern over an image, which occurs as a result of the agglomeration of a colorless fluid when ultraviolet rays are irradiated onto the colorless fluid after the start of the agglomeration thereof. For this reason, this aspect of the invention makes it possible to form a decorative print image (e.g., three-dimensional image).

BRIEF DESCRIPTION OF THE DRAWINGS

The invention will be described with reference to the accompanying drawings, wherein like numbers reference like elements.

FIG. 4A is a perspective view of the head unit 40, whereas FIG. 4B is a front view that schematically illustrates an example of the configuration of a head 42, which is viewed in a direction shown by an arrow F in FIG. 4A.

FIG. 6A is a diagram that schematically illustrates an example of a glossy image, whereas FIG. 6B is a diagram that schematically illustrates an example of a decorative image.

DESCRIPTION OF EXEMPLARY EMBODIMENTS

Overall Explanation of Ink-Jet Printer

Taking an ink-jet printer, which is hereafter referred to as a printer 1, as an example of various kinds of fluid ejecting apparatuses, an example of the configuration of the printer 1 as well as an example of print processing that is performed thereby will now be explained in detail below.

Configuration of Printer 1

Figure 1:
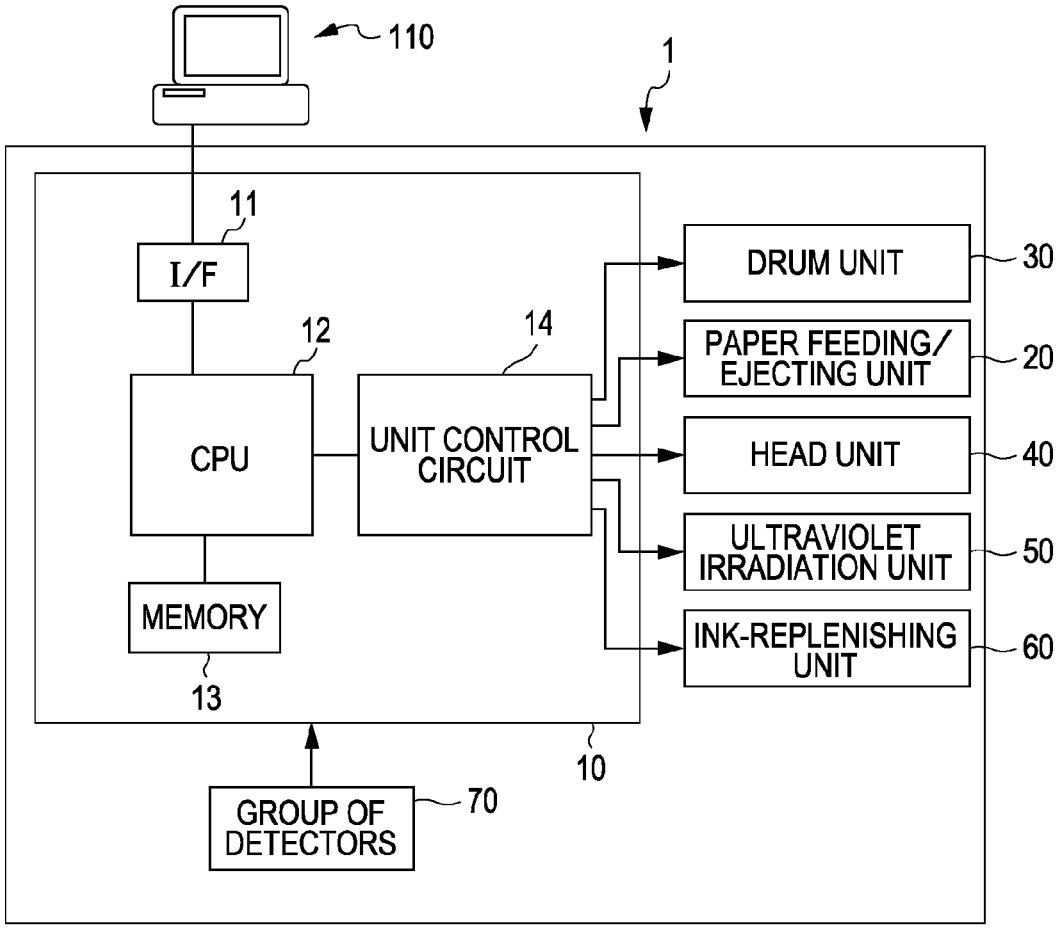
FIG. 1 is a block diagram that schematically illustrates an example of the overall configuration of a printer 1.
Figure 2:
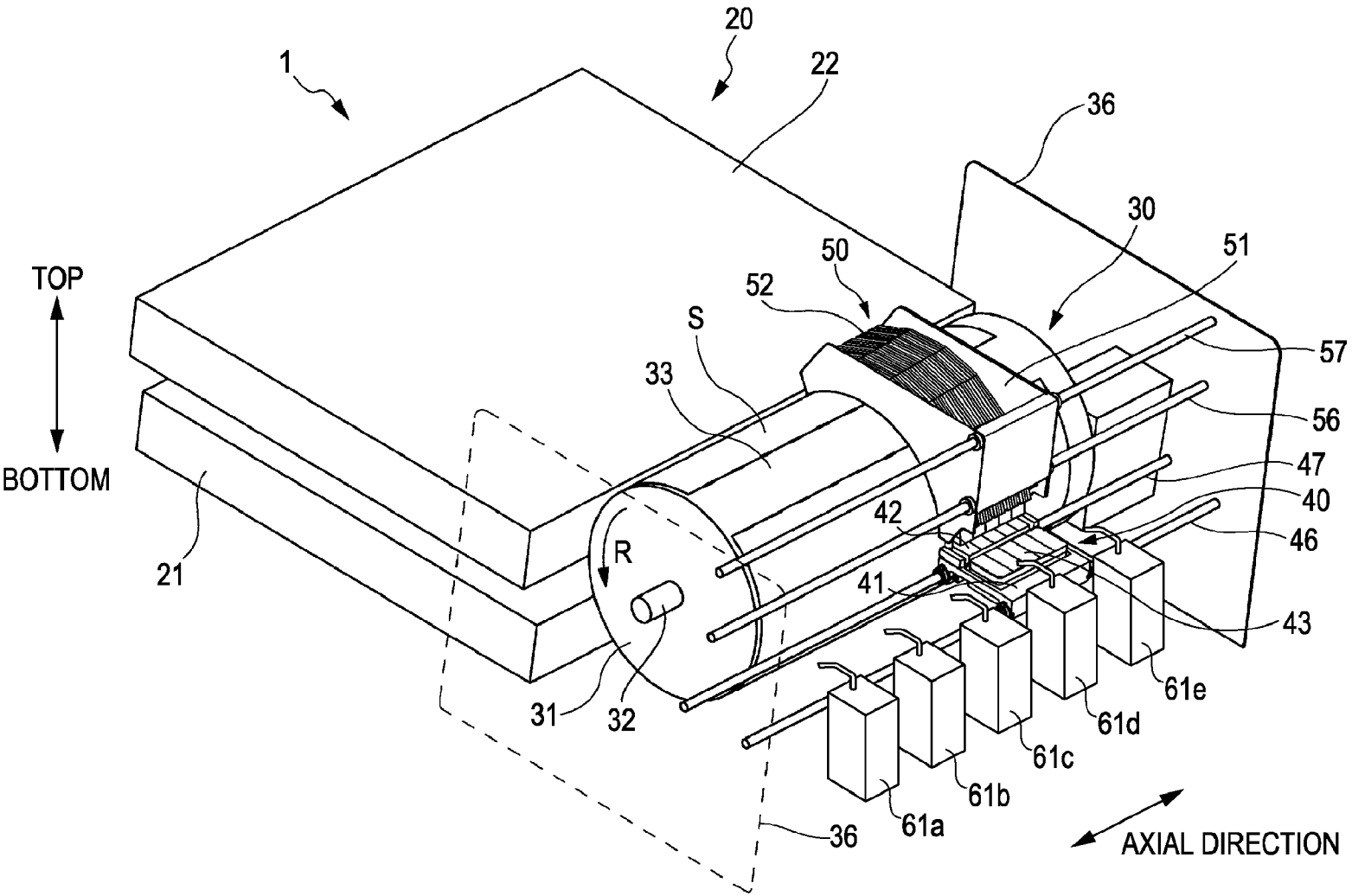
FIG. 2 is a perspective view that schematically illustrates an example of main components of the printer 1.
Figure 3:
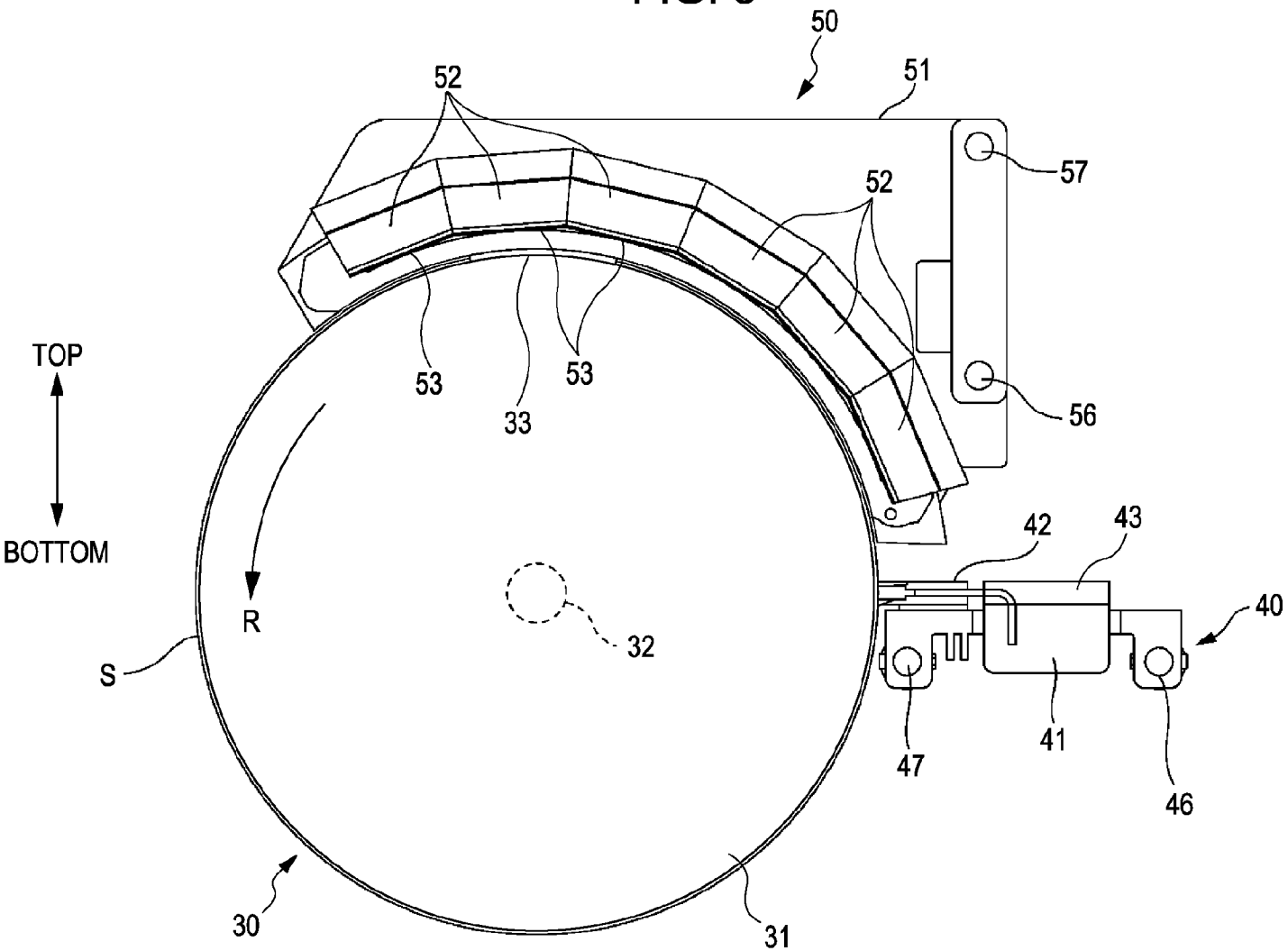
FIG. 3 is a sectional view that schematically illustrates an example of the cross-sectional structure of a drum unit 30, a head unit 40, and an ultraviolet irradiation unit 50.
Figure 4A:
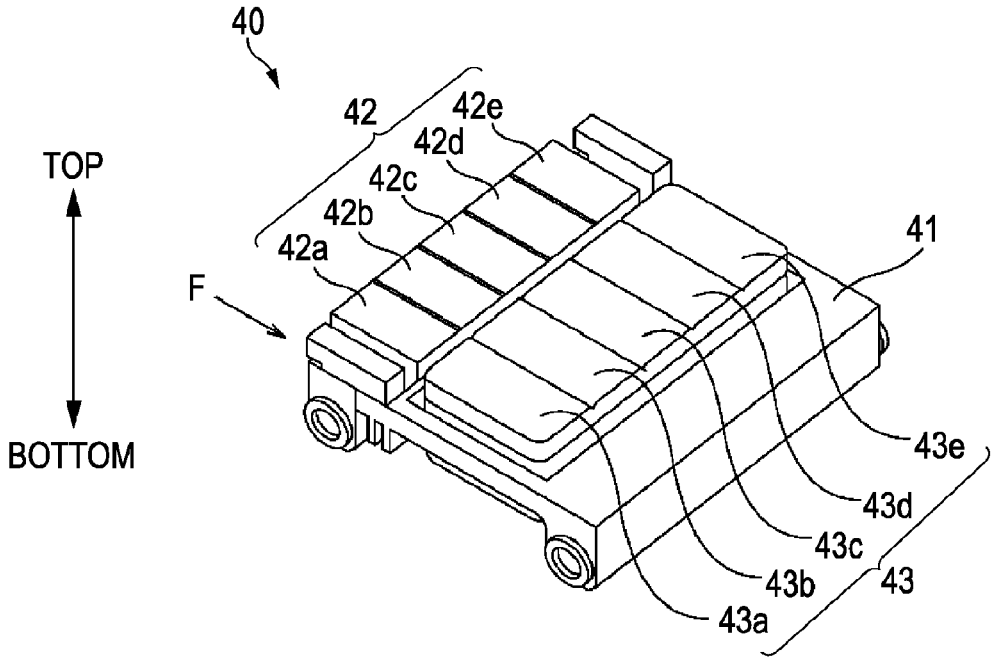
FIGS. 4A and 4B are a set of diagrams that schematically illustrates an example of the configuration of the head unit 40; more specifically.
Figure 4B:
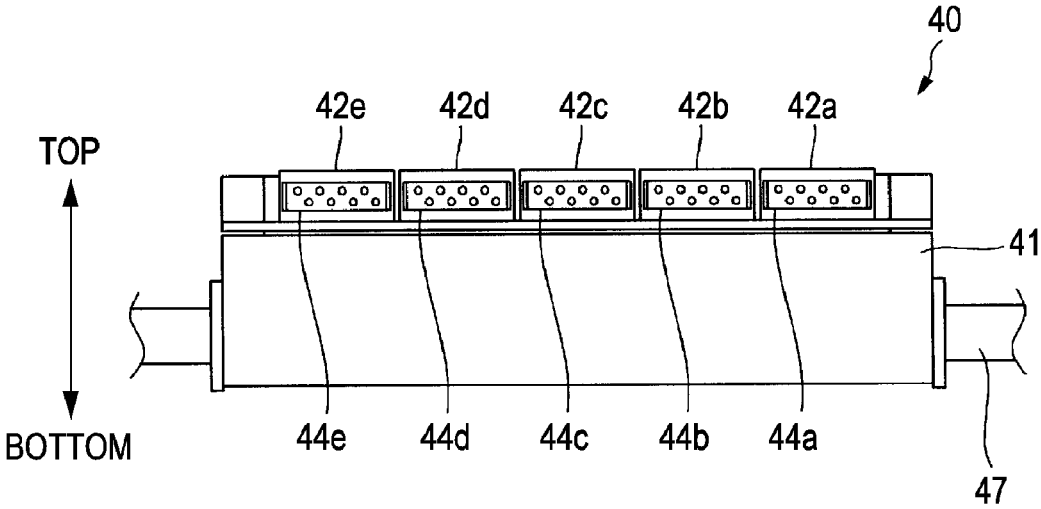
Figure 5:
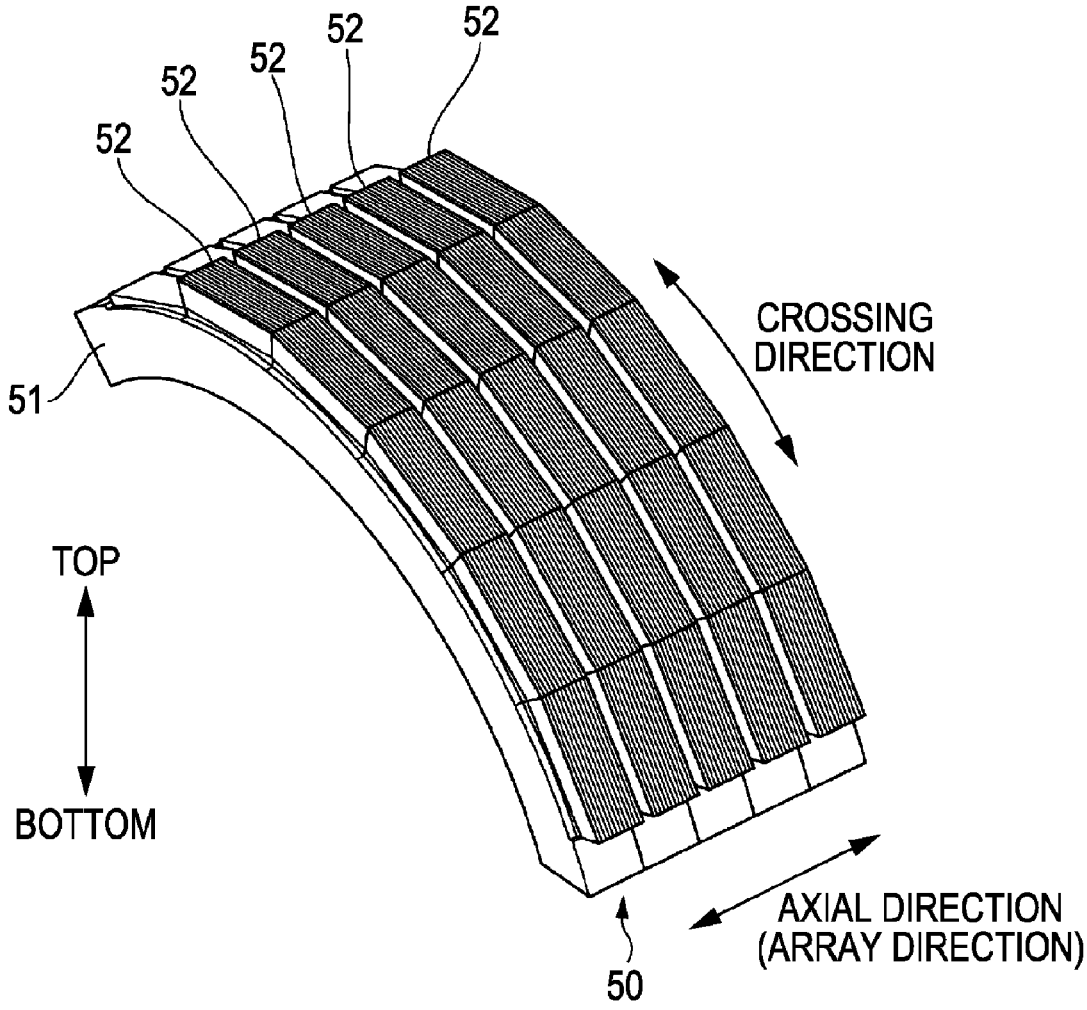
FIG. 5 is a perspective view that schematically illustrates an example of the configuration of the ultraviolet irradiation unit 50.

FIG. 1 is a block diagram that schematically illustrates an example of the overall configuration of the printer 1. FIG. 2 is a perspective view that schematically illustrates an example of main components of the printer 1. FIG. 3 is a sectional view that schematically illustrates an example of the cross-sectional structure of a drum unit 30, a head unit 40, and an ultraviolet irradiation unit 50. The head unit 40 that is described in this specification is a non-limiting example of a fluid ejecting section according to an aspect of the invention. FIG. 4A is a perspective view that schematically illustrates an example of the configuration of the head unit 40. FIG. 4B is a front view that schematically illustrates an example of the configuration of a head 42, which is viewed in a direction shown by an arrow F in FIG. 4A. FIG. 5 is a perspective view that schematically illustrates an example of the configuration of the ultraviolet irradiation unit 50.

The printer 1 includes a controller 10, a paper feeding/ejecting unit 20, the drum unit 30, the head unit 40, the ultraviolet irradiation unit 50, and ink-replenishing unit 60. Upon receiving print data from a computer 110, which is provided as an external apparatus, the controller 10 of the printer 1 performs control on each of the component units mentioned above so as to form an image on a sheet of printing paper S (e.g., print processing). The printer 1 further includes a group of detectors 70. The group of detectors 70 monitors the internal operation state of the printer 1. On the basis of the result of the detection, the controller 10 controls the operation of each unit.

The controller 10 is a controlling unit, which controls the operation of the printer 1. The controller 10 that is described in this specification is a non-limiting example of a controlling section according to an aspect of the invention. An interface unit 11 is a unit that performs data transmission/reception between the computer 110 and the printer 1. A CPU 12 is a central processing unit that performs arithmetic processing for controlling the entire operation of the printer 1. A memory 13 provides a memory area for storing programs, a work area, and the like for the operation of the CPU 12. In accordance with a program that is stored in the memory 13, the CPU 12 controls each unit through a unit controlling circuit 14.

As illustrated in FIG. 2, the paper feeding/ejecting unit 20 is made up of a paper-feeding part (i.e., unit) 21 and a paper-ejecting part 22. The paper-feeding part 21 includes a paper-feeding roller that transports a sheet of printing paper S. The paper-feeding roller, which is not illustrated in the drawing, picks up one sheet of printing paper S at the time of execution of each pickup operation out of a stack of sheets that are set in the paper-feeding part 21. The pickup operation is performed in a sequential manner, that is, one after another. In this way, the paper-feeding part 21 feeds a sheet of printing paper S to the drum unit 30. On the other hand, the paper-ejecting part 22 includes a paper-ejecting roller that transports a sheet of paper S. The paper-ejecting roller is also not illustrated in the drawing. The paper-ejecting roller transports a sheet of print-completed paper S that is held on the drum unit 30 into the paper-ejecting part 22.

The drum unit 30 includes a paper support drum 31. The paper support drum 31 holds a sheet of printing paper S that has been fed from the paper-feeding part 21. A pair of frames 36 supports the rotation shaft 32 of the paper support drum 31 in such a manner that the paper support drum 31 can rotate around the turning axis 32. With a sheet of printing paper S being held on the circumferential surface 33 thereof, the paper support drum 31 turns together with the sheet of printing paper S held thereon in a direction shown by an arrow R in FIG. 2.

The head unit 40 includes a head carriage 41, which is supported on a pair of guiding shafts 46 and 47. The head carriage 41 can reciprocate in the axial direction of the paper support drum 31. The head carriage 41 is provided with the head 42. The head 42 ejects ink onto a sheet of printing paper S. In the configuration of the printer 1 according to the present embodiment of the invention, five heads 42*a*, 42*b*, 42*c*, 42*d*, and 42*e* (refer to FIG. 4B) are provided so as to make up the head 42. These five heads 42*a*-42*e* eject ink whose colors are different from one another. The heads 42*a*-42*e* are provided so as to face a sheet of printing paper S that is held on the paper support drum 31. The heads 42*a*, 42*b*, 42*c*, 42*d*, and 42*e* are provided with nozzle plates 44*a*, 44*b*, 44*c*, 44*d*, and 44*e*, respectively. A plurality of nozzles is formed in each of the nozzle plates 44*a*-44*e*. Ink is ejected from each nozzle. A pressure generation chamber and a driving element are provided for each nozzle. The pressure generation chamber is a compartment, concavity, or the like in which ink is retained. The pressure generation chamber is not illustrated in the drawing. The driving element causes a change in the capacity of the pressure generation chamber so as to eject ink from the nozzle. An example of the driving element is a piezoelectric element.

The head carriage 41 is provided with ink compartments 43*a*, 43*b*, 43*c*, 43*d*, and 43*e* (refer to FIG. 4A). Each of the ink compartments 43*a*-43*e* reservoirs ink such as pigment-based ink as a temporary container, that is, as a reservoir. These ink compartments 43*a*, 43*b*, 43*c*, 43*d*, and 43*e* are provided so as to correspond to the heads 42*a*, 42*b*, 42*c*, 42*d*, and 42*e*. Each of the ink compartments 43*a*-43*e* reservoirs ink that is to be supplied to the corresponding head 42*a*-42*e*. Specifically, the ink compartment 43*a* reservoirs clear ink that is to be supplied to the head 42*a*. The ink compartment 43*b* reservoirs yellow ink that is to be supplied to the head 42*b*. The ink compartment 43*c* contains magenta ink that is to be supplied to the head 42*c*. The ink compartment 43*d* reservoirs cyan ink that is to be supplied to the head 42*d*. The ink compartment 43*e* contains black ink that is to be supplied to the head 42*e*. The clear ink is colorless and transparent ink, whereas each of the yellow ink, the magenta ink, the cyan ink, and the black ink is colored ink. Accordingly, the head unit 40 is capable of ejecting colored ink and colorless ink onto a sheet of printing paper S.

The printer 1 according to the present embodiment of the invention uses ultraviolet ray curing ink, which cures, that is, hardens, due to exposure to ultraviolet rays. The ultraviolet ray curing ink is prepared by adding an adjuvant (i.e., auxiliary material or auxiliary substance) such as anti-foaming agent, polymerization inhibitor, and the like to a mixture of vehicle, photo-initiator, and pigment. The vehicle is prepared by adjusting the viscosity of a material having photo-polymerization curing property such as oligomer, monomer, or the like having such property with the use of reactive diluent. The ink encompasses both of water-based ink and oil-based ink.

The ultraviolet irradiation unit 50 includes an irradiation unit carriage 51, which is supported on a pair of guiding shafts 56 and 57. The irradiation unit carriage 51 can reciprocate in the axial direction of the paper support drum 31. The irradiation unit carriage 51 is provided with an irradiation unit 52 (or a plurality of irradiation units 52). The irradiation unit 52, which is the beam emitter of the ultraviolet irradiation unit 50, irradiates ultraviolet rays onto ink that was ejected from the head 42 in the form of an ink drop and has landed on the surface of a sheet of printing paper S. The irradiation unit 52 is provided with a plurality of lamps 53. These lamps 53 are arrayed in the direction of the rotation of the paper support drum 31. An example of the lamp 53 is a metal halide lamp. Ink cures as a result of the irradiation of ultraviolet rays from the plurality of lamps 53 onto the ink that is put on/over the surface of a sheet of printing paper S.

The ink-replenishing unit 60 re-supplies ink to the head unit 40, or more specifically, to the ink compartments 43*a*-43*e* thereof when the amount of ink that remains therein has become low due to ink ejection from the heads 42*a*-42*e*. The ink-replenishing unit 60 is provided with ink cartridges 61*a*, 61*b*, 61*c*, 61*d*, and 61*e*. Each of the plurality of ink cartridges 61*a*-61*e* contains ink that is to be replenished to the corresponding one of the ink compartments 43*a*-43*e*. For example, the ink cartridge 61*a* is a clear ink container that contains clear ink that is to be re-supplied to the clear ink compartment 43*a*.

Print Processing

Upon receiving printing instructions and print data from the computer 110, the controller 10 analyzes the content of various commands that are included in the print data. Then, the controller 10 controls each unit so as to perform the following print processing. As a first step of print processing, the paper-feeding part 21 of the paper feeding/ejecting unit 20 feeds a sheet of printing paper S to the paper support drum 31. The sheet of printing paper S that has been fed to the paper support drum 31 is curled around the circumferential surface 33 of the paper support drum 31 in tight contact therewith. In this way, the sheet of printing paper S is held on the paper support drum 31. Then, the sheet of printing paper S that is held on the paper support drum 31 turns together with the holder drum 31. Each head 42 ejects ink onto the sheet of printing paper S, which is now rotating. While the sheet of printing paper S moves in a turning direction as the paper support drum 31 rotates, the irradiation unit 52 irradiates ultraviolet rays onto the ink that landed on the sheet of printing paper S. As a result, the ink that lies on the sheet of printing paper S cures. In this way, an image is formed on the sheet of printing paper S. During a 360-degree rotation of the paper support drum 31, an image is printed on the sheet of printing paper S at a partial area viewed in the axial direction of the paper support drum 31. Thereafter, the head carriage 41 moves along the pair of guiding shafts 46 and 47. In addition, the irradiation unit carriage 51 also moves along the pair of guiding shafts 56 and 57. Then, a set of operations explained above, that is, the ejection of ink from the head 42 of the head unit 40 and the subsequent irradiation of ultraviolet rays from the irradiation unit 52 of the ultraviolet irradiation unit 50, is performed in the next partial area. The next partial area is adjacent to one mentioned above when viewed in the axial direction of the paper support drum 31. Through the repetition of the operations explained above, an image is printed on the entire area of the sheet of printing paper S when viewed in the axial direction of the paper support drum 31. Thereafter, the sheet of printing paper S is removed from the paper support drum 31 and then is transported to the paper-ejecting part 22 of the paper feeding/ejecting unit 20. Then, print processing ends.

Glossy Image and Decorative Image

For example, depending on the preference of a user who uses the printer 1, there is a demand for printing a glossy image (e.g., coated image) and a decorative image. The printer 1 according to the present embodiment of the invention is capable of printing a glossy image and a decorative image.

Figure 6A:
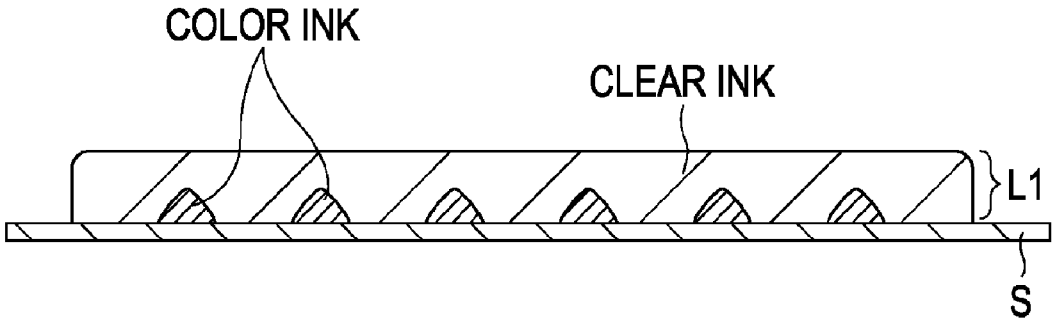
FIGS. 6A and 6B are a set of diagrams that schematically illustrates an example of images that can be printed with the use of the printer 1; more specifically.

FIG. 6A is a diagram that schematically illustrates an example of a glossy image. An image that is illustrated in FIG. 6A is formed as a result of covering color ink with the use of clear ink as a covering layer. The illustrated print image is formed as follows. As a first step, color ink is ejected onto a sheet of printing paper S so as to form an image pattern corresponding to image data that is to be printed out. Then, ultraviolet rays are irradiated onto the color ink that has landed on the surface of the sheet of printing paper S so as to cure the color ink. Next, after one rotation (i.e., 360-degree rotation) of the paper support drum 31, clear ink is ejected so as to cover the hardened color ink substantially (i.e., almost) throughout the entire area of the sheet of printing paper S. Herein, the clear ink has an affinity to the color ink. Because of the affinity between the clear ink and the color ink, a flat layer of the clear ink that covers the color ink is formed. The flat layer of the clear ink is hereafter referred to as a coating layer L1 or a clear cover layer L1. Next, ultraviolet rays are irradiated onto the clear ink so as to cure the clear ink. In this way, the print image that is illustrated in FIG. 6A is formed. Since the clear ink is colorless and transparent ink, the image that is illustrated in FIG. 6A is formed as glossy one.

Figure 6B:
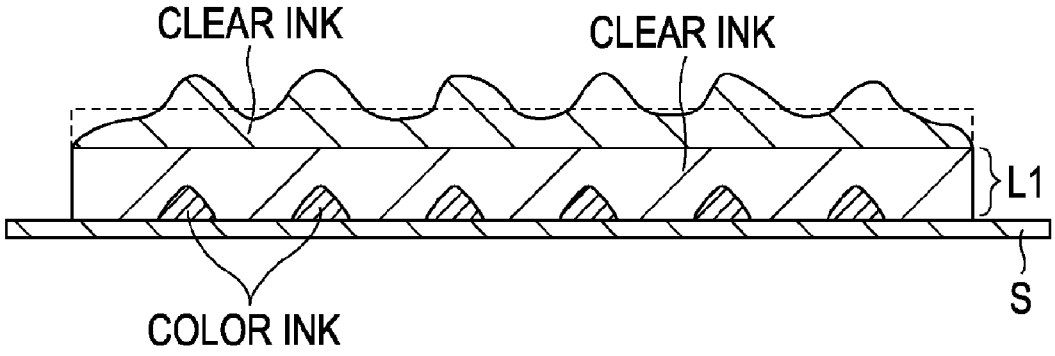

FIG. 6B is a diagram that schematically illustrates an example of a decorative image. The decorative image illustrated in FIG. 6B includes a layer having a concavo-convex uneven surface that is formed over the image illustrated in FIG. 6A, or more specifically, the coating layer L1 thereof. In the following description of this specification, the concavo-convex irregular pattern may be referred to as "artificial emboss", which encompasses the meaning of quasi emboss, pseudo emboss, and false emboss without any limitation thereto. The illustrated print image is formed as follows. As a first step, the image illustrated in FIG. 6A, which includes the coating layer L1, is formed in accordance with the procedures explained above. Next, clear ink is ejected onto the surface of the coating layer L1 substantially throughout the entire area thereof. Herein, the clear ink that has not yet been exposed to ultraviolet rays does not have an affinity to the cured clear ink, the latter of which is the material of the coating layer L1. For this reason, the clear ink that lies on the coating layer L1 starts to agglomerate after the lapse of a certain length of time since the ejection of the clear ink onto the surface of the clear cover layer L1. After the start of the agglomeration of the clear ink, ultraviolet rays are irradiated onto the clear ink. As a result, a concavo-convex irregular pattern is formed over the coating layer L1. Since the concavo-convex irregular pattern formed thereon gives a three-dimensional appearance to the base image layer and thus looks as, for example, an embossed image to a user, the image illustrated in FIG. 6B is formed as decorative one as a whole.

Processing Performed for Printing Glossy Image and Decorative Image

As an example of an image formation method according to an aspect of the invention, the printer 1 is capable of selectively performing first print processing and second print processing in order to form a glossy image and a decorative image explained above. The first print processing explained below is a non-limiting example of first operation according to an aspect of the invention. The second print processing explained below is a non-limiting example of second operation according to an aspect of the invention. Specifically, the printer 1 selects either one of the first print processing and the second print processing in each print execution depending on an image that is to be printed. In the following description of exemplary embodiments of the invention, the first print processing refers to processing for printing a glossy and decorative image. On the other hand, the second print processing refers to processing for printing a glossy image. In the following description of the present embodiment of the invention, the details of the first print processing will be explained first, followed by the explanation of the details of the second print processing.

First Print Processing

Figure 7:
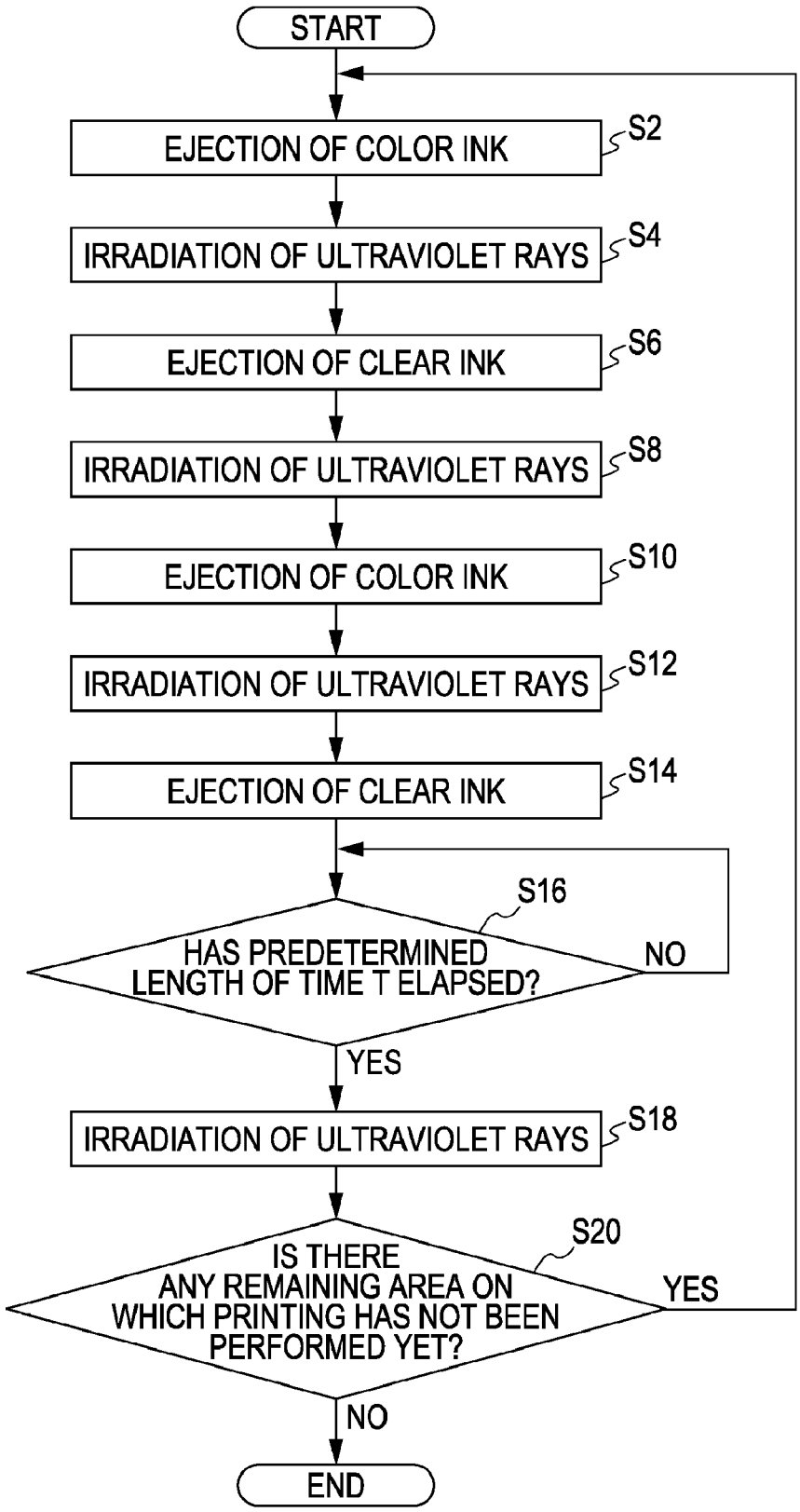
FIG. 7 is a flowchart that schematically illustrates an example of the operation flow of a first print processing according to an exemplary embodiment of the invention.

FIG. 7 is a flowchart that schematically illustrates an example of the operation flow of the first print processing according to an exemplary embodiment of the invention. FIGS. 8A-8I are a set of diagrams each of which schematically illustrates an example of the state of ink on/over a sheet of printing paper S. Note that the controller 10 controls the operations of the printing units of the printer 1 as the main controlling unit thereof when the first print processing explained below is carried out. The same holds true for the second print processing. In particular, in the configuration of the printer 1 according to the present embodiment of the invention, the CPU 12 processes a program(s) that is stored in the memory 13 when the controller 10 performs such control. The program is made up of codes for performing various kinds of operations explained below.

Figure 8A:
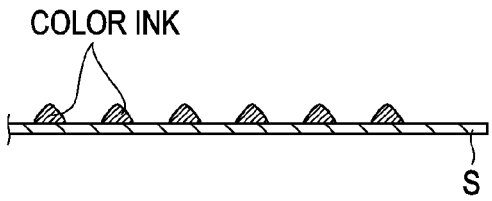
FIGS. 8A-8I are a set of diagrams each of which schematically illustrates an example of the state of ink on/over a sheet of printing paper S.

Upon receiving a command for carrying out the first print processing (i.e., print instructions) from the computer 110, as a first step thereof, the controller 10 performs control so that color ink is ejected onto a sheet of printing paper S (step S2). That is, in this step, the head 42 ejects color ink onto the sheet of printing paper S that is held on the paper support drum 31 during the rotation thereof. As a result, the color ink lands on the surface of the sheet of printing paper S as illustrated in FIG. 8A.

Figure 8B:
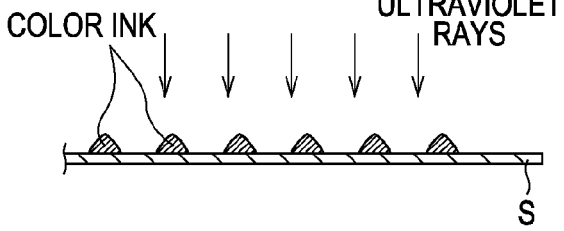

Next, the controller 10 causes the paper support drum 31 that holds the sheet of printing paper S to further rotate so that ultraviolet rays are irradiated onto the color ink that landed on the surface of the sheet of printing paper S (step S4). That is, the irradiation unit 52 irradiates ultraviolet rays onto the color ink that lies on the surface of the sheet of printing paper S as illustrated in FIG. 8B. Due to exposure to the ultraviolet rays, the color ink cures.

Figure 8C:
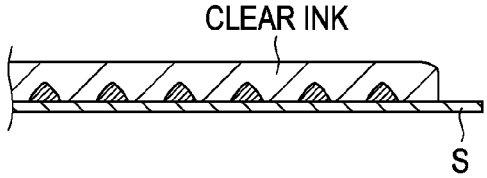

Next, the controller 10 causes the paper support drum 31 to rotate 360 degrees and causes the head 42 to eject clear ink over the hardened color ink (step S6). Specifically, the head 42 ejects clear ink not only onto the surface of the cured color ink but also onto the surface of the sheet of printing paper S at a non-colored area on which the color ink did not land. As a result, the clear ink covers the surface of the hardened color ink over the surface of the sheet of printing paper S as shown in FIG. 8C.

Figure 8D:
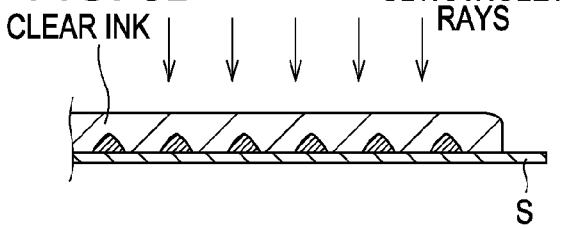

Then, as illustrated in FIG. 8D, the controller 10 performs control so that ultraviolet rays are irradiated onto the clear ink (step S8). Due to exposure to the ultraviolet rays, the clear ink cures, which constitutes the coating layer L1 that covers the color ink. Consequently, a glossy image is formed. In the following description of this specification, this image is referred to as a print image P for the purpose of explanation. It should be particularly noted that the clear ink mentioned above cures without causing any agglomeration because it is exposed to ultraviolet rays immediately after the landing thereof. As explained above, the controller 10 performs control so that clear ink is ejected onto the surface of color ink that landed on the surface of a sheet of printing paper S and then was exposed to ultraviolet rays as well as onto the surface of the sheet of printing paper S at a non-colored area on which the color ink did not land. Then, before the clear ink starts to agglomerate, the controller 10 performs control so that ultraviolet rays are irradiated onto the clear ink. In this way, the print image P is formed over the surface of the sheet of printing paper S.

Figure 8E:
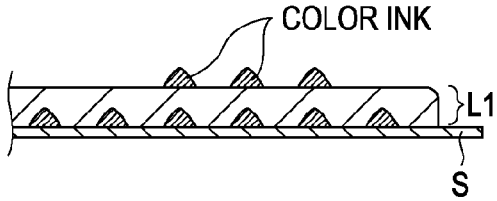

Next, the controller 10 causes the paper support drum 31 to rotate 360 degrees and causes the head 42 to eject color ink on some area part of the surface of the coating layer L1 of the print image P as illustrated in FIG. 8E (step S10). That is, in this step, the controller 10 performs control so that the color ink is ejected on a part of the surface area of the layer of the clear ink that has cured due to exposure to ultraviolet rays. Therefore, second layer color ink lands over the surface of the sheet of printing paper S. Herein, the area where color ink is ejected in a substantially overlapping manner so as to form a dual layer structure is an area part at which it is desired to increase, for example, the shade/depth of an image as well as the degree of coloration (i.e., greater color development) thereof.

Figure 8F:
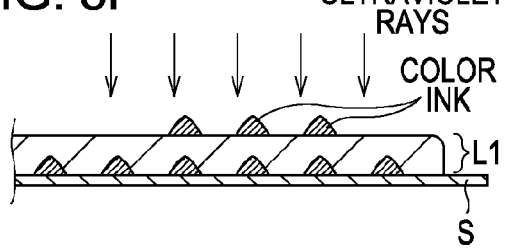

Next, in the same manner as done in the previous step S4, the controller performs control so that ultraviolet rays are irradiated onto the color ink (step S12). That is, in this step, the irradiation unit 52 irradiates ultraviolet rays onto the color ink so as to cure the color ink as illustrated in FIG. 8F.

Figure 8G:
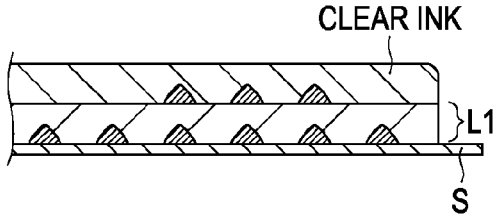

Next, the controller 10 causes the paper support drum 31 to rotate 360 degrees and causes the head 42 to further eject clear ink onto the surface of the color ink that has cured due to exposure to the ultraviolet rays through the preceding process as well as onto the exposed surface of the cured clear ink that constitutes the coating layer L1 as illustrated in FIG. 8G (step S14). In the preceding sentence, the term "the exposed surface of the cured clear ink" means an area part of the surface of the coating layer L1 on which the upper-layer color ink did not land. Specifically, in this process, the head 42 ejects clear ink over the layer surface of the print image P substantially throughout the entire area thereof.

Figure 8H:
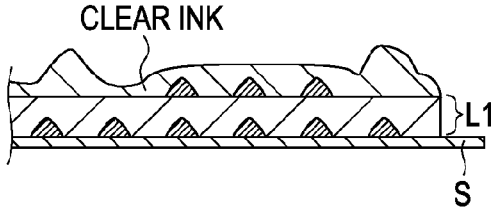

Herein, the ejected clear ink has an affinity to color ink. In other words, the clear ink according to the present embodiment of the invention has hydrophilic property (lipophilic/oleophilic property) with respect to color ink. In addition, the clear ink has hydrophilicity with respect to a sheet of printing paper S, too. On the other hand, the clear ink ejected in this process does not have an affinity to the clear ink that constitutes the coating layer L1. In other words, the clear ink according to the present embodiment of the invention has hydrophobic property (lipophobic/oleophobic property) with respect to the cured clear ink. In the preceding sentence, the term "hydrophobic property" means water-repellent property whereas each of the terms "lipophobic" and "oleophobic" means oil-repellent property. Having the property explained above, the clear ink that has landed on the color ink deposits well on (e.g., is not repelled by) the color ink and thus forms a coating layer that covers the color ink. Because of the formation of the coating layer, the gloss level of the image increases. On the other hand, the ejected clear ink that has landed on the coating layer L1 (i.e., the cured clear ink) starts to agglomerate as illustrated in FIG. 8H after the lapse of a certain length of time since the ejection thereof onto the surface of the cured clear ink layer L1. Note that the relationship between the hydrophilic property of ink and the hydrophobic property thereof corresponds to the relationship between the lipophilic/oleophilic property of ink and the lipophobic/oleophobic property thereof in the description of this specification. In other words, the relationship between the water affinity of ink and the water repellency thereof corresponds to the relationship between the oil affinity of ink and the oil repellency thereof in the description of this specification.

Next, the controller 10 makes a judgment as to whether a predetermined length of time T, which was set in advance, has elapsed since the ejection of the clear ink in the preceding step S14 or not (step S16). The predetermined length of time T is a time period that was experimentally determined. The predetermined length of time T is preset to be long enough so that it can be expected that the agglomeration of the clear ink has already started when it elapses. Therefore, the controller 10 judges that the clear ink has agglomerated when the predetermined length of time T has elapsed. On the other hand, it is judged that the clear ink has not agglomerated yet before the lapse of the predetermined length of time T. For example, the predetermined length of time T is a time period during which the paper support drum 31 rotates twice (i.e., 720 degrees). Needless to say, the predetermined length of time T may be set as a time period during which the paper support drum 31 rotates three times or more.

Figure 8I:
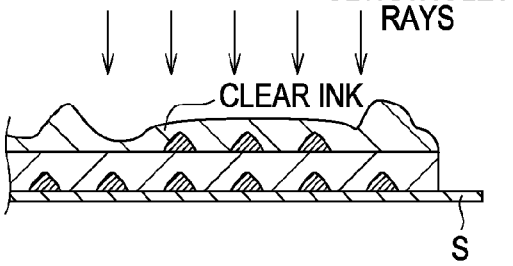

If it is judged that the predetermined length of time T has elapsed (step S16: Yes), as illustrated in FIG. 8I, the controller 10 performs control so that ultraviolet rays are irradiated onto the clear ink that has already started to agglomerate (step S18). That is, after the start of the agglomeration of the clear ink, the irradiation unit 52 irradiates ultraviolet rays onto the clear ink. Due to exposure to the ultraviolet rays, the clear ink cures after the start of the agglomeration thereof. As a result, a concavo-convex irregular pattern (i.e., artificial emboss) is formed over the coating layer L1.

As explained in detail above, the controller 10 performs control so that clear ink is further ejected over the surface of another clear ink that has cured due to exposure to ultraviolet rays. The cured lower-layer clear ink constitutes a part of the print image P. After the start of the agglomeration of the first-mentioned clear ink, ultraviolet rays are irradiated thereon. As a result, artificial emboss is formed as an upper layer over the coating layer L1. Thus, it is possible to form a print image that has a decorative finish.

As the predetermined time period mentioned above becomes longer, the agglomeration of the clear ink proceeds. In other words, as the irradiation is performed at a later point in time, the degree of the agglomeration of the clear ink becomes greater depending upon how late the irradiation is performed (i.e., depending on irradiation timing). As the agglomeration of the clear ink proceeds, the convex of the irregular pattern becomes larger. Thus, it is possible to make the convex of the irregular pattern larger by setting the irradiation timing at a later point in time. In addition, the convex of the irregular pattern tends to be larger as the amount of the ejection of the clear ink increases. Thus, it is possible to make the convex of the irregular pattern larger by setting the amount of the ejection of the clear ink at a larger value. As explained above, the controller 10 can change the degree of the agglomeration of the clear ink either by changing the ejection amount of the clear ink or by changing the timing of the irradiation of ultraviolet rays, or by changing both of them, so as to adjust the protrusion size of a convex pattern that is formed over the coating layer L1. In addition, it is possible to adjust the interval of the convexes formed thereon. Thus, it is possible to form a decorative print image.

Note that the head carriage 41 and the irradiation unit carriage 51 are set at the same axial position (refer to FIG. 2) during the execution of the steps S2-S18 explained above. That is, the ejection of the color ink and the clear ink as well as the irradiation of ultraviolet rays is performed on the same area of a sheet of printing paper S when viewed in the axial direction.

Next, if there is any remaining area part of the sheet of printing paper S on which image printing has not been performed yet (step S20: Yes), the controller 10 causes the head carriage 41 and the irradiation unit carriage 51 to move in the axial direction. Then, a series of image formation procedures explained above (the steps S2-S18) is performed in, for example, the next partial area that is adjacent to the current one on which the printing of the print image P has now completed when viewed in the axial direction. On the other hand, if it is judged that there is not any remaining area part of the sheet of printing paper S on which image printing has not been performed yet (step S20: No), the controller 10 ends the first print processing. In this way, the printing of a glossy and decorative image on the entire area of the sheet of printing paper S ends.

Second Print Processing

Figure 9:
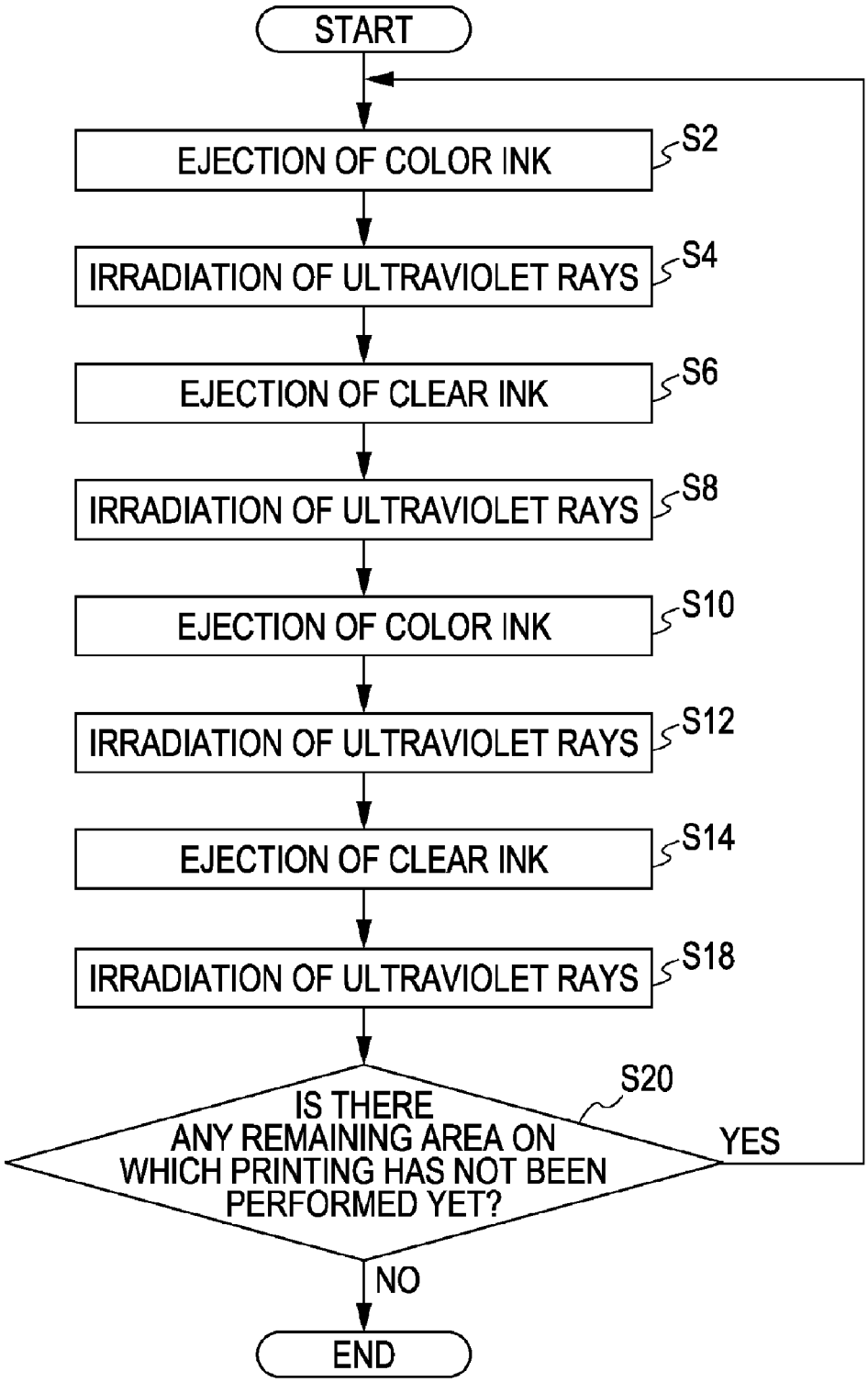
FIG. 9 is a flowchart that schematically illustrates an example of the operation flow of a second print processing according to an exemplary embodiment of the invention.
Figure 10A:
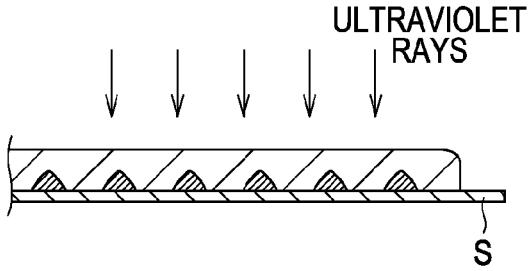
FIGS. 10A-10E are a set of diagrams each of which schematically illustrates an example of the state of ink on/over a sheet of printing paper S.
Figure 10B:
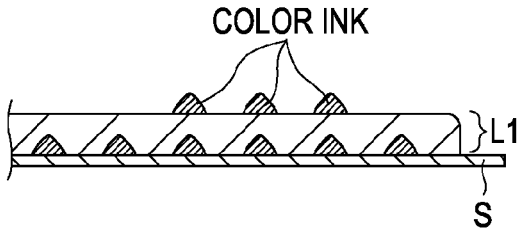
Figure 10C:
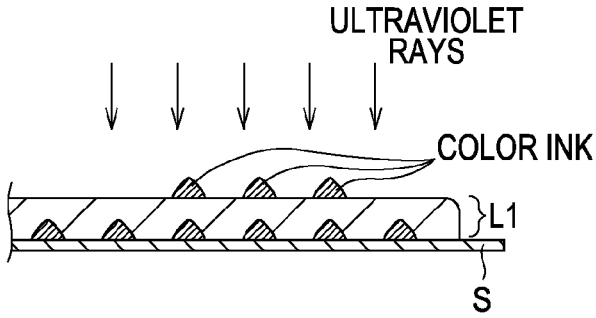

FIG. 9 is a flowchart that schematically illustrates an example of the operation flow of a second print processing according to an exemplary embodiment of the invention. FIGS. 10A-10D are a set of diagrams each of which schematically illustrates an example of the state of ink on/over a sheet of printing paper S. The same steps as those of the steps S2-S12 of the first print processing explained above are performed in the second print processing. As an initial process, the controller 10 performs control for outputting a print image P on a sheet of printing paper S. That is, as illustrated in FIG. 10A, an image that is made up of color ink that cured due to exposure to ultraviolet rays and a coating layer L1 is printed on the sheet of printing paper S. This process corresponds to the steps S2-S8 shown in FIG. 9. Then, the controller 10 causes the head 42 to further eject color ink onto a part of the surface of the coating layer L1 as illustrated in FIG. 10B (step S10). Thereafter, as illustrated in FIG. 10C, the controller 10 causes the irradiation unit 52 to irradiate ultraviolet rays onto the color ink that lies on the part of the surface of the coating layer L1 (step S12).

Figure 10D:
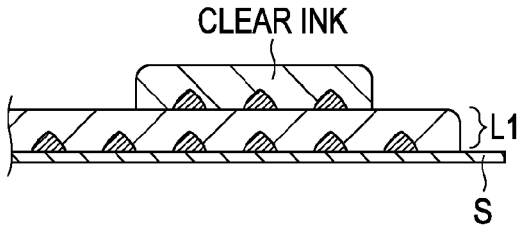
Figure 10E:
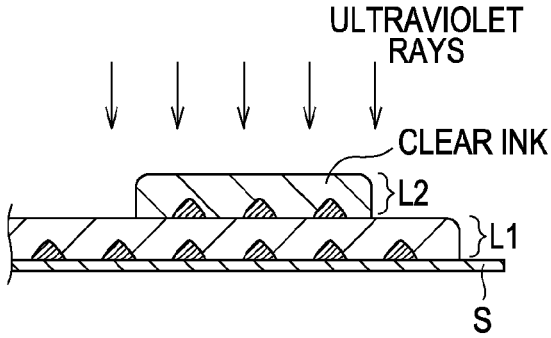

Next, the controller 10 causes the head 42 to further eject clear ink (step S14). In the first print processing explained above, clear ink is ejected onto the surface of color ink that has cured due to exposure to ultraviolet rays as well as onto the exposed surface of the coating layer L1 (refer to FIG. 8G). That is, in the first print processing, clear ink is ejected on/over the entire surface of the coating layer L1 inclusive of the surface of the color ink. In contrast, in the second print processing, clear ink is ejected locally onto the surface of color ink inclusive of an area in the neighborhood of the color ink as illustrated in FIG. 10D.

In addition, unlike the first print processing according to which clear ink agglomerates (refer to FIG. 8H) the second print processing is performed without causing the agglomeration of clear ink. That is, in the second print processing, the controller does not execute the step S16 of the first print processing. Accordingly, after the ejection of the clear ink in the step S14, the controller 10 performs control so that ultraviolet rays are irradiated onto the clear ink before the clear ink starts to agglomerate (step S18). As a result, since the clear ink cures before it starts to agglomerate, a flat over-coating layer is formed.

Next, if there is any remaining area part of the sheet of printing paper S on which image printing has not been performed yet (step S20: Yes), the controller 10 causes the head carriage 41 and the irradiation unit carriage 51 to move in the axial direction. Then, a series of image formation procedures explained above (the steps S2-S14 and S18) is performed in, for example, the next partial area that is adjacent to the current one on which the printing of an image has now completed when viewed in the axial direction.

No concavo-convex irregular clear-ink pattern is formed over the coating layer L1 in the second print processing. On the other hand, since the color ink is deposited in a dual-layer structure, the shade/depth of an image as well as the degree of coloration thereof enhances, thereby improving image quality. As explained above, in a case where image quality should be prioritized over the decoration of an image, the second print processing is selected. With the selection of the second print processing, it is possible to reduce the amount of consumption of clear ink and to avoid a decrease in printing speed.

Examples of Advantageous Effects Offered by Printer 1 According to the Present Embodiment of the Invention In the print processing (first print processing) explained above, the controller 10, which controls the ink ejection operation of the head 42 of the head unit 40 and the ultraviolet-ray irradiation operation of the irradiation unit 52 of the ultraviolet irradiation unit 50, performs control so that (1) clear ink is ejected over a print image P that is made up of color ink that has landed on the surface of a sheet of printing paper S and the coating layer L1 and that (2) ultraviolet rays are irradiated onto the clear ink that has been ejected over the print image P after the start of the agglomeration of the clear ink (refer to FIGS. 8A-8I). Through such a series of controlling operations, it is possible to form a decorative image as explained below. That is, as a result of the agglomeration of the clear ink as illustrated in FIG. 8H, a concavo-convex irregular pattern is formed over the print image P, which is an image that is made up of the color ink and the coating layer L1. Since ultraviolet rays are irradiated onto the clear ink after the start of the agglomeration thereof, it is possible to form a final print image that has a concavo-convex irregular pattern (i.e., three-dimensional image) as illustrated in FIG. 8I. Thus, it is possible to form a decorative print image.

As explained above, the controller 10 performs control so that clear ink is further ejected over another clear ink that has cured due to exposure to ultraviolet rays (refer to FIG. 8G). Then, the controller 10 performs control so that ultraviolet rays are irradiated onto the clear ink after the start of the agglomeration thereof (refer to FIG. 8I). Therefore, it is possible to print an image having a concavo-convex irregular pattern effectively. Clear ink that has not yet been exposed to ultraviolet rays does not have an affinity to cured clear ink (e.g., hydrophobic property). Because of such repellency, the clear ink that has landed on the cured clear ink has a greater tendency to agglomerate with the passage of time than otherwise. Since the formation of a concavo-convex irregular pattern over the print image P is facilitated, it is possible to effectively print an embossed image or other concavo-convex image.

As explained earlier, the controller 10 is capable of performing the first print processing and the second print processing. Specifically, the controller 10 selects either one of the first print processing and the second print processing depending on an image that is to be printed. Therefore, it is possible to provide a printer having versatility. For example, if a user desires to print a glossy image with vivid coloration, which means that the quality of an image is prioritized, the second print processing is selected. On the other hand, if a user prefers to print a decorative image, the first print processing is selected. As explained above, it is possible to provide the printer 1 having versatility through the selection of print processing that is suited for a desired print image, where the selection is made, for example, in accordance with the preference of a user.

As explained earlier, the controller 10 causes the head 42 to eject color ink on a part of the surface area of the layer of clear ink that has cured due to exposure to ultraviolet rays (refer to FIG. 8E). That is, the controller 10 performs control so that the color ink is ejected on some area part of the surface of the coating layer L1. Thereafter, the controller 10 performs control so that ultraviolet rays are irradiated onto the color ink (refer to FIG. 8F). Next, the controller 10 causes the head 42 to further eject clear ink onto the surface of the color ink that has cured due to exposure to the ultraviolet rays through the preceding process as well as onto the exposed surface of the cured clear ink that constitutes the coating layer L1 (refer to FIG. 8G). The exposed surface of the cured clear ink means an area part of the surface of the coating layer L1 on which the upper-layer color ink did not land. Then, the controller 10 performs control so that ultraviolet rays are irradiated onto the clear ink after the start of the agglomeration thereof (refer to FIG. 8I). Through these steps, it is possible to print a decorative image having excellent image quality. The clear ink that has landed thereon includes an area part that is formed on the surface of the cured clear ink and an area part that is formed on the surface of the cured color ink. The clear ink that has landed on the surface of the cured clear ink agglomerates so as to form a concavo-convex irregular pattern (i.e., artificial emboss) over the coating layer L1. On the other hand, the clear ink that has landed on the surface of the cured color ink forms a flat over-coating layer that covers the color ink because of the affinity between the clear ink and the color ink. Therefore, it is possible to print a glossy image with vivid coloration. Thus, it is possible to print a decorative image having excellent image quality.

Print Processing According to Second Embodiment of the Invention

Figure 11:
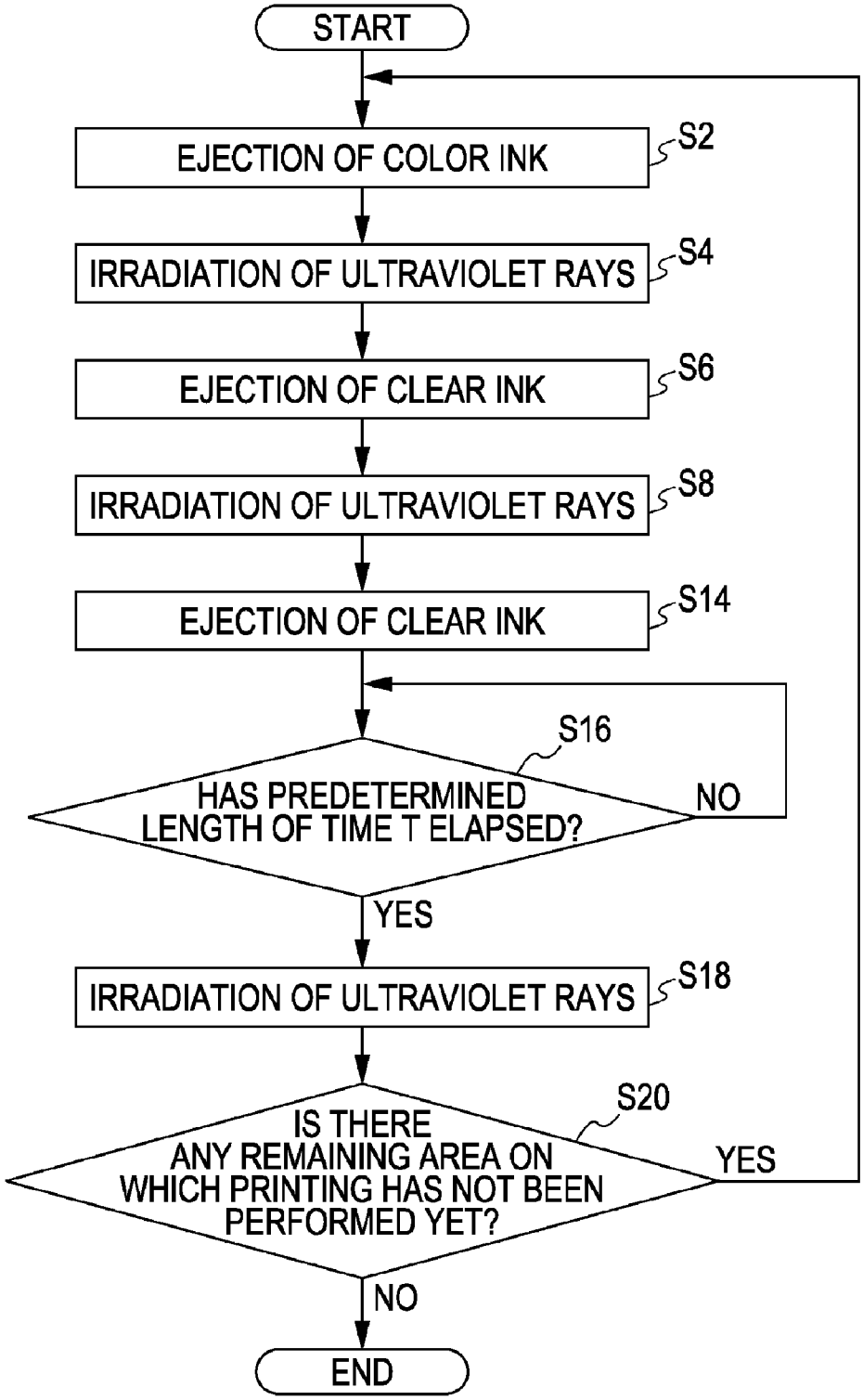
FIG. 11 is a flowchart that schematically illustrates an example of the operation flow of print processing according to a second embodiment of the invention.
Figure 12A:
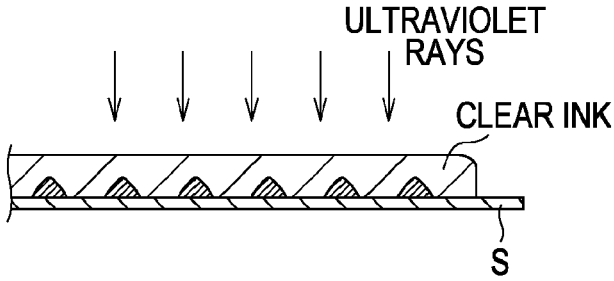
FIGS. 12A-12D are a set of diagrams each of which schematically illustrates an example of the state of ink on/over a sheet of printing paper S.

FIG. 11 is a flowchart that schematically illustrates an example of the operation flow of print processing according to a second embodiment of the invention. FIGS. 12A-12D are a set of diagrams each of which schematically illustrates an example of the state of ink on/over a sheet of printing paper S. The steps S2-S8 (illustrated in FIGS. 7 and 9) of print processing according to the foregoing exemplary embodiment of the invention, which is hereafter referred to as a first embodiment, are executed in print processing according to the second embodiment of the invention. As an initial process, the controller 10 performs control for outputting a print image P on a sheet of printing paper S. That is, as illustrated in FIG. 12A, an image that is made up of color ink that cured due to exposure to ultraviolet rays and a coating layer L1 is printed on the sheet of printing paper S. This process corresponds to the steps S2-S8 shown in FIG. 11.

Figure 12B:
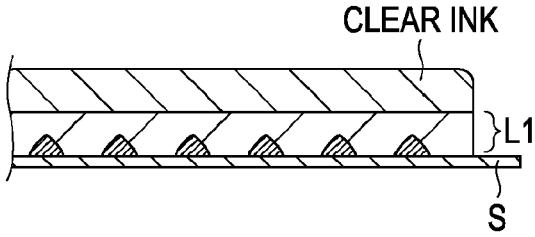

In the print processing according to the first embodiment of the invention, the head 42 ejects color ink onto a part of the surface of the coating layer L1 as illustrated in FIGS. 8E and 10B. In contrast, in the print processing according to the second embodiment of the invention, the head 42 does not eject color ink onto the surface of the coating layer L1. Accordingly, the controller 10 performs control so that clear ink only is ejected onto the surface of the coating layer L1 (print image P) (step S14). That is, the head 42 ejects clear ink onto the surface of the coating layer L1 substantially throughout the entire area thereof as illustrated in FIG. 12B. However, the scope of this aspect of the invention is not limited to such an example. As a modification example thereof, the clear ink may be ejected onto a part of the surface of the coating layer L1.

Figure 12C:
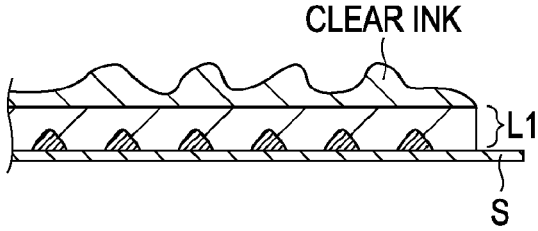
Figure 12D:
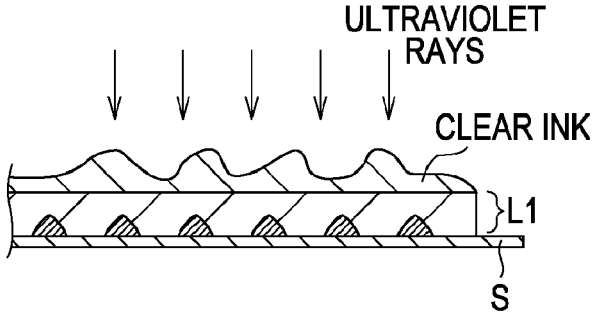

Next, the controller 10 makes a judgment as to whether a predetermined length of time T, which was set in advance, has elapsed since the ejection of the clear ink in the preceding step S14 or not (step S16). After the lapse of the predetermined length of time T, as explained earlier, the clear ink starts to agglomerate as illustrated in FIG. 12C. If it is judged that the predetermined length of time T has elapsed, as illustrated in FIG. 12D, the controller 10 performs control so that ultraviolet rays are irradiated onto the clear ink (step S18). That is, after the start of the agglomeration of the clear ink, the irradiation unit 52 irradiates ultraviolet rays onto the clear ink. As a result, a concavo-convex irregular pattern (i.e., artificial emboss) is formed over the coating layer L1.

Next, if there is any remaining area part of the sheet of printing paper S on which image printing has not been performed yet (step S20: Yes), the controller 10 causes the head carriage 41 and the irradiation unit carriage 51 to move in the axial direction. Then, a series of image formation procedures explained above (the steps S2-S8 and the steps S14-S18) is performed in, for example, the next partial area that is adjacent to the current one on which the printing of the print image P has now completed when viewed in the axial direction.

In the same manner as done in the first print processing according to the first embodiment of the invention, as a result of the execution of print processing according to the second embodiment of the invention, artificial emboss is formed as an upper layer over the coating layer L1. Thus, it is possible to form a print image that has a decorative finish. In particular, since the artificial emboss is formed substantially throughout the entire area on the surface of the coating layer L1 in the print processing according to the second embodiment of the invention, it is possible to print a decorative image.

Print Processing According to Third Embodiment of the Invention

Figure 13:
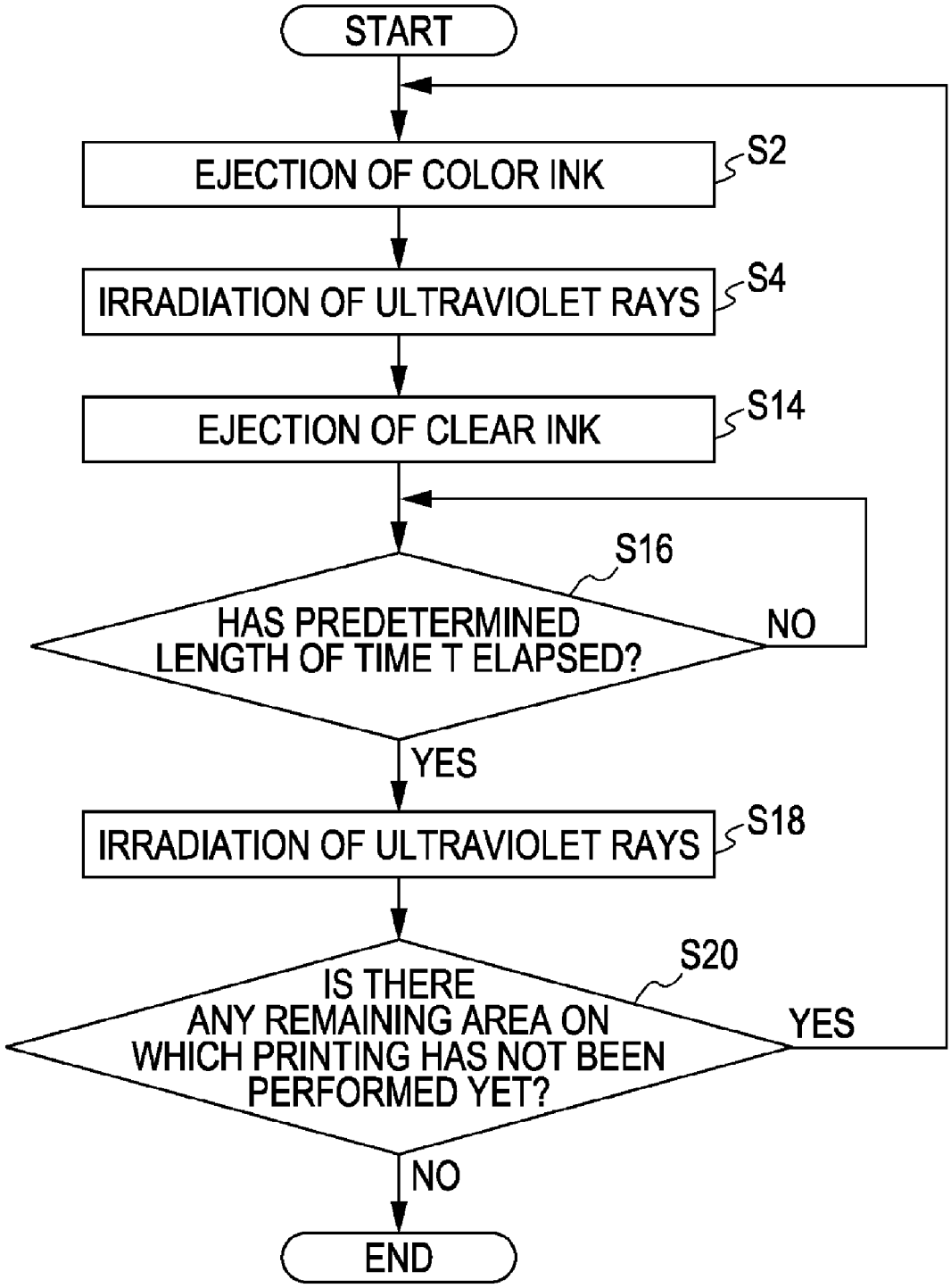
FIG. 13 is a flowchart that schematically illustrates an example of the operation flow of print processing according to a third embodiment of the invention.
Figure 14A:
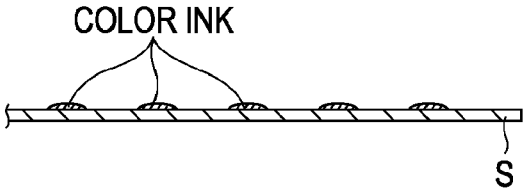
FIGS. 14A-14E are a set of diagrams each of which schematically illustrates an example of the state of ink on/over a sheet of printing paper S.
Figure 14B:
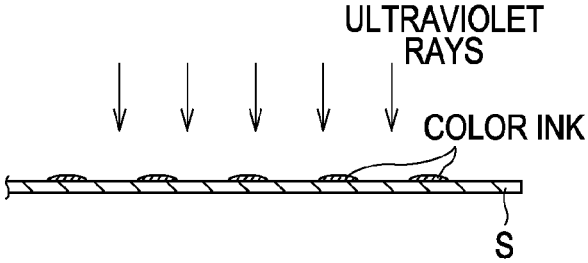
Figure 14C:
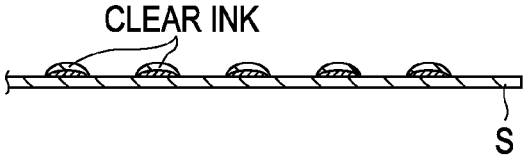

FIG. 13 is a flowchart that schematically illustrates an example of the operation flow of print processing according to a third embodiment of the invention. FIGS. 14A-14E are a set of diagrams each of which schematically illustrates an example of the state of ink on/over a sheet of printing paper S. Unlike the print processing according to the first embodiment of the invention, the coating layer L1 is not formed in the print processing according to the third embodiment of the invention. Specifically, as illustrated in FIG. 14A, the controller 10 performs control so that color ink is ejected on the surface of a sheet of printing paper S. This process is shown as the step S2 in FIG. 13. Then, as illustrated in FIG. 14B, the controller 10 performs control so that ultraviolet rays are irradiated onto the color ink that has landed on the surface of the sheet of printing paper S. This process is shown as the step S4 in FIG. 13. In the print processing according to the third embodiment of the invention, after the formation of the cured color ink on the surface of the sheet of printing paper S, the formation of the coating layer L1 with the use of clear ink is not performed. For this reason, the print image P according to the third embodiment of the invention is made of the color ink only that was ejected in the step S2.

As explained earlier, the clear ink according to each of the first embodiment of the invention and the second embodiment of the invention has an affinity to color ink (e.g., hydrophilic property). In contrast, the clear ink according to the third embodiment of the invention does not have an affinity to color ink (e.g., hydrophobic property) Therefore, the clear ink that has landed on the color ink agglomerates with the passage of time.

Next, in order to form a convex (artificial emboss) on the surface of the color ink, which cured due to exposure to ultraviolet rays, the controller 10 causes the head 42 to eject clear ink onto the surface of the color ink (step S14).

Figure 14D:
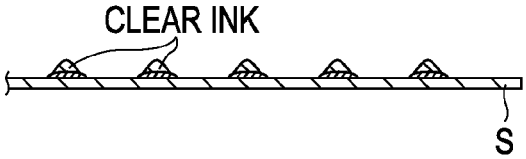
Figure 14E:
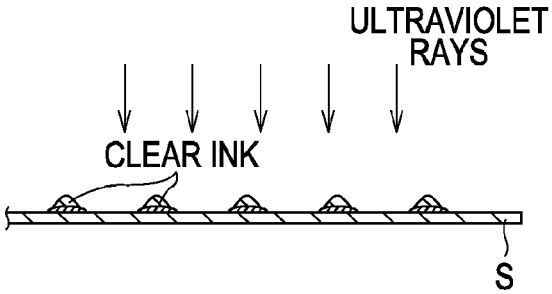

Next, the controller 10 makes a judgment as to whether a predetermined length of time T, which was set in advance, has elapsed since the ejection of the clear ink in the preceding step S14 or not (step S16). The predetermined length of time T is a time period after the lapse of which the clear ink starts to agglomerate over the color ink as illustrated in FIG. 14D. If it is judged that the predetermined length of time T has elapsed, as illustrated in FIG. 14E, the controller 10 performs control so that ultraviolet rays are irradiated onto the clear ink (step S18). That is, after the start of the agglomeration of the clear ink, the irradiation unit 52 irradiates ultraviolet rays onto the clear ink. As a result, a convex (i.e., artificial emboss) is formed over the color ink.

In the same manner as done in the first print processing according to the first embodiment of the invention, as a result of the execution of print processing according to the third embodiment of the invention, artificial emboss is formed as an upper layer over the color ink. Thus, it is possible to form a print image that has a decorative finish. In particular, since the coating layer L1 is not formed in the print processing according to the third embodiment of the invention, it is possible to print a decorative image quickly while reducing the amount of consumption of clear ink.

It is explained above that the clear ink is ejected on the surface of the color ink only in the print processing according to the third embodiment of the invention. However, the scope of this aspect of the invention is not limited to such an example. As a modification example thereof, the clear ink may be ejected substantially throughout the entire surface area of the sheet of printing paper S inclusive of the surface of the color ink.

Other Embodiments

In the foregoing description, the present invention is explained while discussing some exemplary embodiments of the invention as well as variations/modifications thereof. These specific embodiments as well as variations/modifications thereof of a fluid ejecting apparatus according to an aspect of the invention are provided solely for the purpose of facilitating the understanding of the invention. It should be noted that, in no case, these explanatory embodiments are interpreted to limit the scope of the invention. The invention may be modified, altered, changed, adapted, and/or improved within a range not departing from the gist and/or spirit of the invention apprehended by a person skilled in the art from explicit and implicit description made herein, where such a modification, an alteration, a change, an adaptation, and/or an improvement is also covered by the scope of the appended claims. It is the intention of the inventor/applicant that the scope of the invention covers any equivalents thereof without departing therefrom.

In the foregoing description of exemplary embodiments of the invention including variations/modifications thereof, it is explained that a fluid ejecting apparatus is embodied as an ink-jet printer. However, the scope of the invention is not limited to such an exemplary configuration. For example, the invention is applicable to a variety of fluid ejecting apparatuses that eject or discharge various kinds of fluid that includes ink but not limited thereto. For example, the scope of the invention covers, without any limitation thereto, a liquid ejecting apparatus that is provided with a liquid ejecting head that ejects liquid onto a liquid ejection target medium. The invention is further applicable to a fluid ejecting apparatus that ejects a liquid/liquefied matter/material that is made as a result of dispersion of particles of functional material(s) into/with liquid. The invention is further applicable to a fluid ejecting apparatus that ejects a gel substance. The invention is further applicable to a fluid ejecting apparatus that ejects other type of non-liquid fluid such as a (semi-) solid substance that can be ejected as a fluid. It should be noted that the scope of the invention is not limited to those enumerated above.

In addition to an ink-jet printer described in the foregoing exemplary embodiments of the invention, a fluid ejecting apparatus to which the invention is applicable encompasses a wide variety of other types of apparatuses that ejects liquid or fluid in which, for example, a color material or an electrode material is dispersed or dissolved, though not necessarily limited thereto. Herein, the color material may be, for example, one that is used in the production of color filters for a liquid crystal display device or the like. The electrode material (i.e., conductive paste) may be, though not limited thereto, one that is used for electrode formation of an organic EL display device, a surface/plane emission display device (FED), and the like. A fluid ejecting apparatuses to which the invention is applicable further encompasses a wide variety of other types of apparatuses such as one that ejects a living organic material used for production of biochips or one that is provided with a sample ejection head functioning as a high precision pipette and ejects liquid as a sample therefrom. Further in addition, the invention is applicable to, and thus can be embodied as, a liquid ejecting apparatus that ejects, with high precision, lubricating oil onto a precision instrument and equipment including but not limited to a watch and a camera. Moreover, the invention is applicable to and thus can be embodied as a liquid ejecting apparatus that ejects liquid of a transparent resin such as an ultraviolet ray curing resin or the like onto a substrate so as to form a micro hemispherical lens (optical lens) that is used in an optical communication element or the like. Furthermore, the invention is applicable to and thus can be embodied as a liquid ejecting apparatus that ejects an etchant such as acid or alkali that is used for the etching of a substrate or the like. In addition, the invention is applicable to and thus can be embodied as a fluid ejecting apparatus that ejects a gel fluid. Moreover, the invention is applicable to and thus can be embodied as a dry-jet type (i.e., powder-ejecting type) recording apparatus that ejects various kinds of solid such as powder or a granular matter/material that includes toner, without any limitation thereto. Without any intention to limit the technical scope of the invention to those enumerated or explained above, the invention can be applied to a variety of ejecting apparatuses that eject or discharge various kinds of fluid, liquid, or the like such as those enumerated or explained above.

It is explained in the foregoing exemplary embodiments of the invention that the lamp 53 of the irradiation unit 52 is a metal halide lamp. However, the invention is not limited to such an exemplary configuration. As a modification example thereof, the lamp 53 of the irradiation unit 52 may be an LED.

An ink ejection method is not limited to one that uses piezoelectric elements. For example, the invention can be applied to a thermal printer without any limitation thereto.

In the foregoing description of exemplary embodiments of the invention, it is explained that the irradiation unit 52 is provided on the irradiation unit carriage 51 whereas the head 42 is provided on the head carriage 41. That is, it is explained therein that the irradiation unit 52 and the head 42 are not provided on the same single carriage. However, the invention is not limited to such an exemplary configuration. That is, the irradiation unit 52 and the head 42 may be provided on the same single carriage.

In the foregoing description of exemplary embodiments of the invention, it is explained that a sheet of printing paper S that has been fed to the paper support drum 31 is curled around the circumferential surface 33 of the paper support drum 31 in tight contact therewith and held on the paper support drum 31 so that ink can be ejected onto the sheet of printing paper S. However, the invention is not limited to such an exemplary configuration. As a modification example thereof, ink may be ejected onto a sheet of printing paper S that is supported by a non-rotary or other fixed supporting member such as a platen or the like. In such a modified configuration, for example, the sheet of printing paper is transported over the platen through the operation of a pair of paper transport rollers or the like.

What is claimed is:

1. A fluid ejecting apparatus comprising:

a fluid ejecting section that ejects a colored fluid and a colorless fluid toward a fluid ejection target medium;

an irradiating section that irradiates ultraviolet rays onto a fluid that lies on or over the fluid ejection target medium so as to cure the fluid; and a controlling section that controls the fluid ejecting operation of the fluid ejecting section and the ultraviolet ray irradiating operation of the irradiating section, the controlling section performing control so that the colorless fluid is ejected on an image that is made of the colored fluid that landed on the fluid ejection target medium, and after the start of the agglomeration of the colorless fluid that landed on the image, the controlling section performing control so that ultraviolet rays are irradiated onto the colorless fluid, wherein, under the control of the controlling section, the image is formed as a result of the ejection of the colorless fluid on the colored fluid that landed on the fluid ejection target medium and then was exposed to ultraviolet rays and the subsequent irradiation of ultraviolet rays onto the colorless fluid before the start of the agglomeration of the colorless fluid; the controlling section performs control so that the colorless fluid is further ejected on the colorless fluid that has cured due to exposure to the ultraviolet rays; and then, after the start of the agglomeration of the colorless fluid, the controlling section performs control so that ultraviolet rays are irradiated onto the colorless fluid.

2. The fluid ejecting apparatus according to claim 1, wherein the controlling section is capable of performing first operation in which, under the control of the controlling section, the colorless fluid is further ejected on the colorless fluid that has cured due to exposure to the ultraviolet rays, which constitutes the image, and then, after the start of the agglomeration of the colorless fluid, ultraviolet rays are irradiated onto the colorless fluid, and is capable of performing second operation in which, under the control of the controlling section, the colored fluid is ejected on a part of the colorless fluid that has cured due to exposure to the ultraviolet rays, which constitutes the image, then, ultraviolet rays are irradiated onto the colored fluid, then, the colorless fluid is further ejected on the colored fluid that has been exposed to the ultraviolet rays, and then, ultraviolet rays are irradiated onto the colorless fluid before the start of the agglomeration of the colorless fluid; and either one of the first operation and the second operation is selected to be performed.

3. The fluid ejecting apparatus according to claim 1, wherein a convex is formed over the image as a result of the curing of the colorless fluid due to exposure to the ultraviolet rays after the start of the agglomeration thereof; and the controlling section changes the degree of the agglomeration of the colorless fluid either by changing the ejection amount of the colorless fluid or by changing the timing of the irradiation of ultraviolet rays, or by changing both of them, so as to adjust the size of the convex that is formed over the image.

4. An image formation method comprising:

ejecting a colorless fluid on an image that is made of a colored fluid that landed on a fluid ejection target medium;

curing the colorless fluid by irradiating ultraviolet rays onto the colorless fluid; and performing, by a controlling section, an operation to control the ejecting of the colorless liquid on the image that is made of the colored fluid and after the start of agglomeration of the colorless liquid and an operation to cause the curing of the irradiating ultraviolet rays, wherein, under the control of the controlling section, the image is formed as a result of the ejection of the colorless fluid on the colored fluid that landed on the fluid ejection target medium and then was exposed to ultraviolet rays and the subsequent irradiation of ultraviolet rays onto the colorless fluid before the start of the agglomeration of the colorless fluid; the controlling section performs control so that the colorless fluid is further ejected on the colorless fluid that has cured due to exposure to the ultraviolet rays; and then, after the start of the agglomeration of the colorless fluid, the controlling section performs control so that ultraviolet rays are irradiated onto the colorless fluid.

5. A fluid ejecting apparatus comprising:

a fluid ejecting section that ejects a colored fluid and a colorless fluid toward a fluid ejection target medium;

an irradiating section that irradiates ultraviolet rays onto a fluid that lies on or over the fluid ejection target medium so as to cure the fluid; and a controlling section that controls the fluid ejecting operation of the fluid ejecting section and the ultraviolet ray irradiating operation of the irradiating section, the controlling section performing control so that the colorless fluid is ejected on an image that is made of the colored fluid that landed on the fluid ejection target medium, and after the start of the agglomeration of the colorless fluid that landed on the image, the controlling section performing control so that ultraviolet rays are irradiated onto the colorless fluid, wherein, under the control of the controlling section, the image is formed as a result of the ejection of the colorless fluid on the colored fluid that landed on the fluid ejection target medium and then was exposed to ultraviolet rays and the subsequent irradiation of ultraviolet rays onto the colorless fluid before the start of the agglomeration of the colorless fluid; the controlling section performs control so that ultraviolet rays are irradiated onto the colored fluid after the ejection of the colored fluid onto a part of the colorless fluid that has cured due to exposure to the ultraviolet rays; the controlling section performs control so that the colorless fluid is further ejected on the colorless fluid and the colored fluid that have cured due to exposure to the ultraviolet rays; and then, after the start of the agglomeration of the colorless fluid, the controlling section performs control so that ultraviolet rays are irradiated onto the colorless fluid.

* * * * *